US006860215B2

(12) United States Patent
Dawson

(10) Patent No.: US 6,860,215 B2
(45) Date of Patent: Mar. 1, 2005

(54) ASSEMBLY FOR CONVERTING A CATAMARAN INTO A TRIMARAN

(76) Inventor: Paul Dawson, 9 Lakewood Drive, Weyba Downs, QLD (AU)

( * ) Notice: Subject to any disclaimer, the term of this patent is extended or adjusted under 35 U.S.C. 154(b) by 0 days.

(21) Appl. No.: 10/469,750

(22) PCT Filed: Mar. 1, 2002

(86) PCT No.: PCT/AU02/00225

§ 371 (c)(1),
(2), (4) Date: Sep. 4, 2003

(87) PCT Pub. No.: WO02/070333

PCT Pub. Date: Sep. 12, 2002

(65) Prior Publication Data

US 2004/0089214 A1 May 13, 2004

(30) Foreign Application Priority Data

Mar. 6, 2001 (AU) ..... PR3599

(51) Int. Cl.[7] ..... B63B 43/14
(52) U.S. Cl. ..... 114/123; 114/61.15
(58) Field of Search ..... 114/123, 61.1, 114/61.14, 61.15, 61.16, 61.17, 61.18, 61.22

(56) References Cited

U.S. PATENT DOCUMENTS

| | | | | |
|---|---|---|---|---|
| 3,673,976 A | * | 7/1972 | Reynolds | 114/61.22 |
| 3,871,316 A | | 3/1975 | Woodrich | |
| 4,836,298 A | | 6/1989 | Laboureau | |
| 5,038,694 A | * | 8/1991 | Yamada et al. | 114/39.25 |

FOREIGN PATENT DOCUMENTS

| | | |
|---|---|---|
| FR | 2533192 | 3/1984 |
| WO | WO 00/69717 | 11/2000 |

* cited by examiner

*Primary Examiner*—Jesus D. Sotelo
(74) *Attorney, Agent, or Firm*—Madson & Metcalf

(57) ABSTRACT

An assembly for converting a catamaran into a trimaran, the assembly comprising a center hull, left and right side linkage members, with each linkage member having front and rear lateral portions and an interconnecting longitudinal portion, and a plurality of adaptors with each adaptor having a bottom surface which is adapted to be located in a catamaran hull tops surface recess for a cross piece and a top surface for receipt of the longitudinal portion, wherein each longitudinal portion is adapted to be connected to forward and rear ends of respective catamaran hulls by a coupling means.

23 Claims, 2 Drawing Sheets

ASSEMBLY FOR CONVERTING A CATAMARAN INTO A TRIMARAN

FIELD OF THE INVENTION

The present invention relates to trimarans.

BACKGROUND OF THE INVENTION

In general catamarans are much more popular and therefore more available than trimarans. Because of this trimarans are normally more expensive because production levels are not high enough to reduce cost through mass production and volume sales.

The design and manufacture of three hulls also makes a trimaran relatively expensive.

It is an objective of the present invention to reduce the costs associated with making a trimaran.

SUMMARY OF THE INVENTION

According to the present invention a method is disclosed for converting a catamaran into a trimaran.

According to one aspect of the present invention there is provided an assembly for converting a catamaran into a trimaran, the assembly comprising a centre hull, left and right side linkage members, with each linkage member having front and rear lateral portions and an interconnecting longitudinal portion, and a plurality of adaptors, with each adaptor having a bottom surface which is adapted to be located in a catamaran hull top surface recess for a cross piece and a top surface for receipt of the longitudinal portion, wherein each longitudinal portion is adapted to be connected to forward and rear ends of respective catamaran hulls by a coupling means.

Preferably the coupling means comprises a plurality of brackets and fixing members.

According to another aspect of the present invention there is provided an adaptor for a catamaran hull comprising a bottom surface which is adapted to be located in a hull recess of the hull which hull recess is adapted to receive a cross piece for connecting two hulls together, a top surface having a recess for receipt of part of a linkage member which is aligned substantially in parallel with the length of the hull, and attachment portions for receipt of attachment means for attaching the linkage member to the hull.

Preferably the attachment portions comprise holes through the top and bottom faces for receipt of securing members.

Preferably the top surface recess extends across the adaptor.

The top surface recess may be concave.

It is preferred that the bottom surface is curved to fit into the hull recess which is concave.

The top surface recess preferably extends at right angles to the hull recess when the adaptor is located in the hull recess.

Preferably hulls are located on either side/above or below the recess of the adaptor.

It is preferred that the top surface of the adaptor is generally flat except for the top surface recess.

According to a further aspect of the present invention there is provided a linkage member for a trimaran, having front and rear lateral portions and an interconnecting longitudinal portion which is adapted to be attached to one catamaran hull and wherein ends of the lateral portions are adapted to be attached to a central hull.

It should be noted that the catamaran hull refers to the catamaran hull which is disconnected from an adjacent catamaran hull and all other components.

The linkage member is preferably U-shaped.

Preferably the longitudinal portion extends at right angles to the lateral portions.

The linkage member is preferably a continuous length of a metal bar.

It is preferred that the longitudinal portion is adapted to be connected through adaptors to recesses of the catamaran hull.

According to a further aspect of the present invention there is provided a trimaran comprising a centre hull, left and right side hulls, left and right side linkage members and a plurality of adaptors interconnecting the left and right side linkage members to the left and right side hulls, wherein the left and right side linkage members each comprise a longitudinal portion which is substantially parallel with the left and right side hulls longitudinal axis.

Preferably the left and right linkage members are C-shaped.

The left and right side hulls preferably have the longitudinal portion extending perpendicular to the side portions.

Preferably the longitudinal portion is raised above the top surface of the left and right side hulls.

Preferably the longitudinal portion is connected to the adaptors with brackets having opposite flange portions which are adapted to abut with top surface portions of the adaptors.

It is preferred that the brackets have channels shaped to the curvature of the longitudinal portions.

The words "comprising, having, including" should be interpreted in an inclusive sense, meaning that additional features may also be added.

BRIEF DESCRIPTION OF THE DRAWINGS

A preferred embodiment of the present invention will now be described by way of example only with reference to the accompanying drawings in which.

DETAILED DESCRIPTION OF THE DRAWINGS

According to the preferred embodiment of the present invention a centre hull is manufactured so that it is able to be matched to any one of the many production types of mass produced catamarans, either new or second hand.

It is preferable to reduce to a minimum the amount of extra rigging/fittings required.

Figure 1:
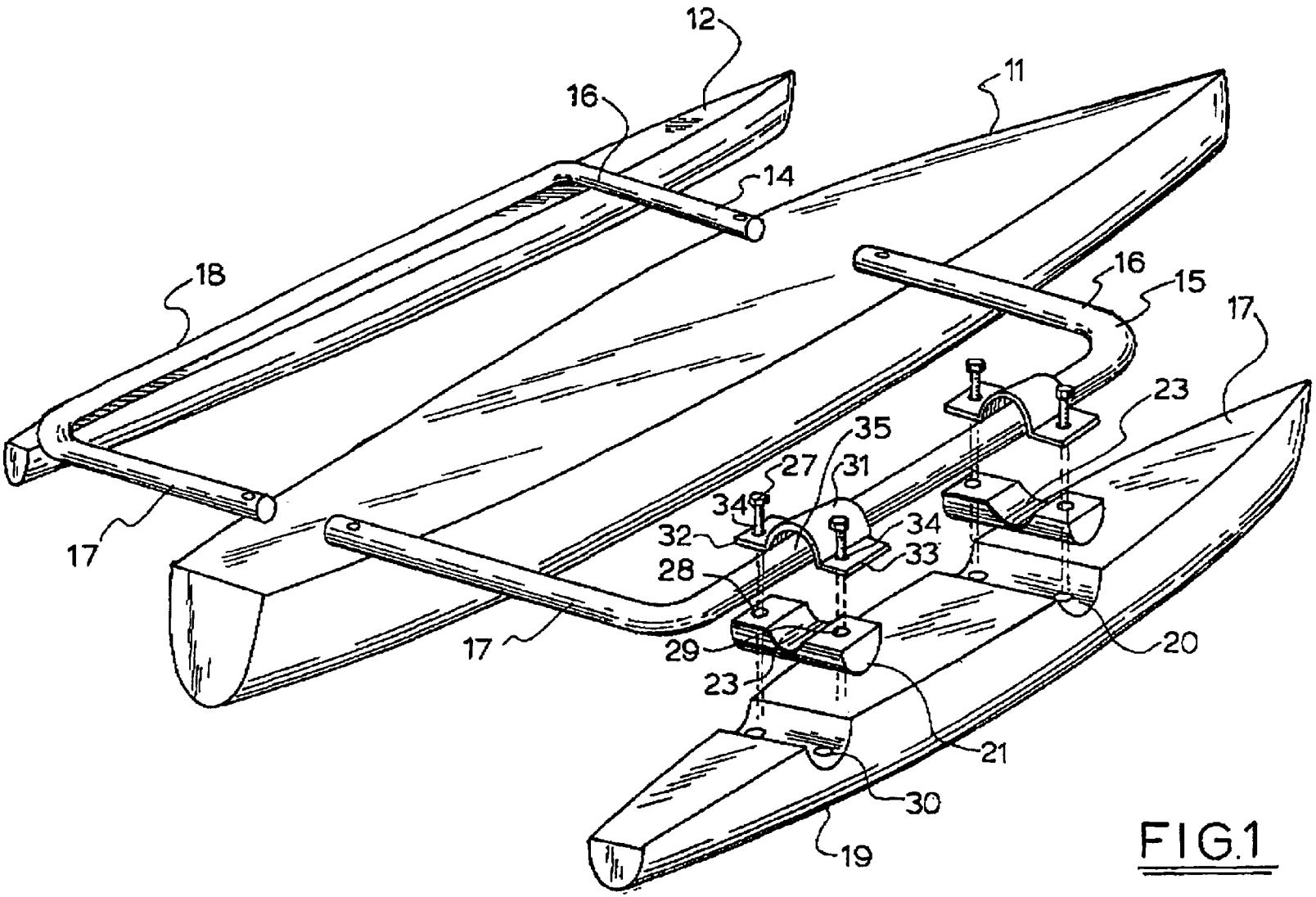
FIG. 1 shows an angle view of a trimaran according to a preferred embodiment of the present invention.

As much of the existing sail/rigging/fittings of the catamaran are used when making the trimaran, although the option to use extra sail/rigging/fittings must always remain open. As shown in FIG. 1 left and right side catamaran hulls 12, 13 are connected to a trimaran hull 11 through U-shaped linkage bars 14, 15.

The U-shaped linkage bars consist of straight forward and rearward lateral sections 16, 17 and a straight longitudinal section 18 extending between distal ends of the lateral sections 16, 17. The longitudinal section 18 runs generally parallel to the central longitudinal axis of both the trimaran hull 11 and the catamaran hulls 12, 13.

Because catamaran hulls are normally connected together by parallel cross pieces, each catamaran hull is provided with transverse recesses 19, 20 at forward and rearward parts of the hull.

Accordingly the longitudinal section 18 of the linkage bars 14, 15 are not able to fit straight into these recesses 19, 20.

For this reason adaptors 21 are provided.

Each adaptor 21 is generally a rectangular block having a lower surface which is specifically shaped to suit the catamaran hull to which it is to be connected.

Figure 2:
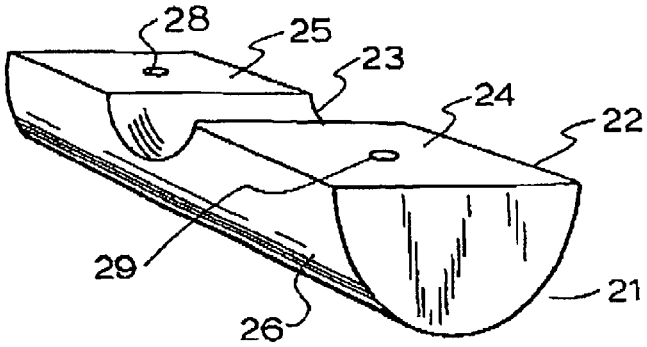
FIG. 2 shows an angle view of an adaptor according to one embodiment of the present invention.

For convenience FIG. 1 shows an adaptor as shown in FIG. 2.

Each adaptor as shown in FIG. 2 has an upper surface 22 with a central transverse concave recess 23. This recess 23 separates two generally flat top surface sections 24, 25.

The lower surface 26 has a generally convex semicircular shape.

Each adaptor 21 is seated in a respective one of the recesses 19, 20 of the catamaran hull and the adjacent longitudinal bar 18 is seated in the top surface recess 23 of the adaptor 21. The longitudinal bar 18 and adaptors 21 are then secured to the catamaran hull by using bracket and bolts 27 which fit through holes 28 and 29 located through top faces 24, 25 of the adaptor 21 and the adjacent top face of the recess 19, 20.

Each curved bracket 31 is curved with opposing flange portions 32, 33 which are placed over the longitudinal bar 18 and has holes 34 which when aligned with holes 28, 29 and 30 permit the through bolts 27 to securely fasten the longitudinal bar 18 to the catamaran hull 12, 13.

It is noted that the bracket 31 has a curved channel 35 which conforms to the shape of the longitudinal bar.

The overall shape of the bracket 31 is designed to match the opposing face of the adaptor 21 to which it is attached.

The shape of the adaptor which is used may vary depending upon the shape of the recess located in each of the catamaran hulls.

Figure 3:
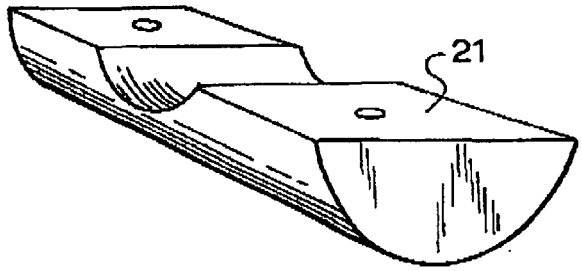
FIG. 3 shows an adaptor according to a second embodiment of the present invention.

Accordingly FIG. 3 shows an adaptor with a lower face having a half wing section.

Figure 4:
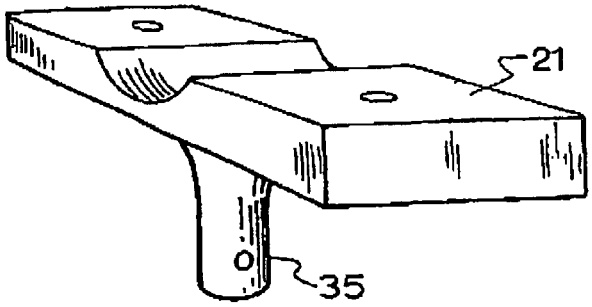
FIG. 4 shows an adaptor according to a third embodiment of the present invention.

FIG. 4 on the other hand shows a lower face with a downwardly extending post or peg 35.

It is noted that each of the adaptors have two through holes, although additional holes may also be provided to strengthen the coupling of the linkage bars to the catamaran hulls.

The ends of the linkage bars 14, 15 are fastened to the main trimaran hull using bolts or any other similar fastening method.

The mast and rigging for the resultant trimaran may involve conventional components and anchoring techniques.

By having an assembly of components as described in the preferred embodiment it is possible to make a trimaran from catamaran hulls using a minimum number of components and at minimum cost.

The present invention also contemplates additional fastening for the longitudinal bars. The adaptors may also be modified to other shapes and may include different shaped recesses to support longitudinal bars having different cross-sectional shapes.

According to another embodiment of the present invention the linkage bars may be attached to the main hull of the trimaran so that initially they are able to move backwards or forwards.

The centre hull may be constructed so that there is sufficient space in the area of the linkage bar attachment positions to allow for a change in the distance between front and rear parts of the linkage bar if the linkage bar is not a continuous C-shaped beam. Accordingly this means that rather than having a C-shaped or U-shaped linkage bar two separate linkage bars may be provided on each side of the main hull with each of these linkage bars being a lateral bar with a short elbow section at its distal end.

According to another embodiment the linkage bars may be pivotally attached to the main hull.

According to a different embodiment the linkage bars may vary in shape such as a Z shape so that they are able to be connected to catamaran hulls of different sizes and shapes.

It is to be understood that, if any prior art publication is referred to herein, such reference does not constitute an admission that the publication forms a part of the common general knowledge in the art, in Australia or in any other country.

What is claimed is:

1. An assembly for converting a catamaran into a trimaran, the assembly comprising a centre hull, left and right side linkage members, with each linkage member having front and rear lateral portions and an interconnecting longitudinal portion, and a plurality of adaptors, with each adaptor having a bottom surface which is adapted to be located in a catamaran hull top surface channel for a cross piece and a top surface configured for receipt of the longitudinal portion, wherein each longitudinal portion is adapted to be connected to forward and rear ends of respective catamaran hulls by a coupling means.

2. The assembly as claimed in claim 1 including attachment means for attaching each adaptor to the catamaran hull.

3. The assembly as claimed in claim 2 wherein each adaptor comprises attachment portions for receipt of the attachment means.

4. The assembly as claimed in claim 3 including the coupling means.

5. The assembly as claimed in claim 4 wherein the coupling means includes the attachment means.

6. The assembly as claimed in claim 1 wherein the top surface is configured with a recess that extends across the adaptor in a direction aligned with the longitudinal axis of the catamaran hull.

7. The assembly as claimed in claim 1 wherein the bottom surface is curved to fit in the channel of the catamaran hull.

8. The assembly as claimed in claim 6 wherein the top surface recess is adapted to extend at substantially right angles to the hull recess in which it is to be located.

9. The assembly as claimed in claim 8 wherein the top surface of the adaptor is generally flat except for the top surface recess.

10. The assembly as claimed in claim 9 wherein the linkage member longitudinal portion extends at right angles to the lateral portions.

11. The assembly as claimed in claim 10 wherein the longitudinal portion is adapted to be received in the top surface recesses of the adaptors so as to be attached thereto by the coupling means.

12. The assembly as claimed in claim 11 wherein the coupling means comprises a bracket which is adapted to be attached to the top surface of the adaptor.

13. An adaptor for a catamaran hull comprising a bottom surface which is adapted to be located in a hull recess of the hull which hull recess is adapted to receive a cross piece for connecting two hulls together, a top surface having a recess for receipt of part of a linkage member which is aligned substantially in parallel with the length of the hull, and attachment portions for receipt of attachment means for attaching the linkage member to the hull.

14. The adaptor as claimed in claim 13 wherein the attachment portions comprise holes through the top and bottom faces for receipt of securing members.

15. The adaptor as claimed in claim 14 wherein the top surface recess extends across the adaptor.

16. The adaptor as claimed in claim 15 wherein the bottom surface is curved to fit into the hull recess which is concave.

17. The adaptor as claimed in claim 16 wherein the top surface recess is concave.

18. The adaptor as claimed in claim 13 including a projection extending from a bottom surface of the adaptor and being for insertion in a receiving hole in the top surface of the catamaran hull.

19. A trimaran comprising a centre hull, left and right side hulls, left and right side linkage members and a plurality of adaptors interconnecting the left and right side linkage members to the left and right side hulls, wherein the left and right side linkage members each comprise a longitudinal portion which is substantially parallel with the left and right side hulls longitudinal axis.

20. The trimaran as claimed in claim 19 wherein the left and right side hulls preferably have the longitudinal portion extending perpendicular to the side portions.

21. The trimaran as claimed in claim 20 wherein the longitudinal portion is raised above the top surface of the left and right side hulls.

22. The trimaran as claimed in claim 21 wherein the longitudinal portion is connected to the adaptors with brackets having opposite flange portions which are adapted to abut with top surface portions of the adaptors.

23. The trimaran as claimed in claim 22 wherein the left and right side linkage members are C-shaped.

* * * * *